US006481699B1

(12) United States Patent
Aihara et al.

(10) Patent No.: US 6,481,699 B1
(45) Date of Patent: Nov. 19, 2002

(54) ACCELERATION DEVICE FOR A TWO-CYCLE ENGINE

(75) Inventors: Tamio Aihara, Miyagi (JP); Hiroki Ogasawara, Shibata-Machi (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 09/688,674

(22) Filed: Oct. 16, 2000

(30) Foreign Application Priority Data

Oct. 21, 1999 (JP) ..... 11-300118

(51) Int. Cl.[7] ..... F02M 7/093
(52) U.S. Cl. ..... 261/34.2; 261/35; 261/44.8
(58) Field of Search ..... 261/34.2, 44.8, 261/35

(56) References Cited

U.S. PATENT DOCUMENTS

| | | | | |
|---|---|---|---|---|
| 2,061,494 A | * | 11/1936 | Weber | 261/34.2 X |
| 2,152,951 A | * | 4/1939 | Bracke | 261/34.2 X |
| 2,313,258 A | * | 3/1943 | Olson | 261/34.2 X |
| 2,768,818 A | * | 10/1956 | Egerer | 261/34.2 X |
| 3,198,187 A | * | 8/1965 | Bartholomew | 261/34.2 X |
| 4,073,278 A | | 2/1978 | Glenn | 123/198 |
| 4,303,047 A | | 12/1981 | Dorsic | 123/327 |
| 4,335,061 A | * | 6/1982 | Kobayashi et al. | 261/44.8 |
| 4,335,062 A | * | 6/1982 | Kobayashi et al. | 261/44.8 |
| 4,481,914 A | * | 11/1984 | Ishida | 261/34.2 X |
| 4,674,465 A | | 6/1987 | Jimenez | 123/577 |
| 5,843,345 A | | 12/1998 | Guntly | 261/34.2 |

FOREIGN PATENT DOCUMENTS

| | | | |
|---|---|---|---|
| JP | 55-119932 | * 9/1980 | 261/34.2 |
| JP | 55-128658 | * 10/1980 | 261/34.2 |
| JP | 57035146 | 2/1982 | |
| JP | 60043122 | 3/1985 | |
| JP | 9268917 | 10/1997 | |
| JP | 00027706 | 1/2000 | |
| JP | 00027707 | 1/2000 | |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

An acceleration device of a carburetor for a two cycle engine with a rotary dual valve which controls air flow through both a scavenging passage and a separate air intake passage each extending through a carburetor body. The carburetor body houses a metering fuel chamber and an air reference chamber defined by a diaphragm between them. Fuel in the metering fuel chamber is discharged through a port into the air intake passage. An acceleration pump has an actuation chamber which communicates with the scavenging passage and a pump chamber which communicates with the air reference chamber and a membrane between them. During engine acceleration the membrane is displaced by a pressure introduced into the actuation chamber to forcibly send air into the air reference chamber from the pump chamber to move, the diaphragm into the metering fuel chamber, and thereby increase the fuel delivered to the air intake passage.

17 Claims, 1 Drawing Sheet

ACCELERATION DEVICE FOR A TWO-CYCLE ENGINE

REFERENCE TO RELATED APPLICATION

Applicants claim the priority of Japanese patent application, Ser. No. 11-300118, filed Oct. 21, 1999.

FIELD OF THE INVENTION

This invention relates to an acceleration device, and more particularly to a carburetor acceleration device for a two-cycle engine.

BACKGROUND OF THE INVENTION

Fuel from a carburetor for a two-cycle engine is fed via negative pressure into an air intake passage where the fuel mixes with the air and is then drawn into a crankcase. From the crankcase, the fuel-and-air mixture is drawn into a combustion chamber and burned. During engine acceleration the suction, or negative pressure, drawing the fuel and air mixture decreases. Therefore, less fuel is drawn into the air intake passage at a time when more fuel is actually required for smooth acceleration. Consequently, two cycle engines have been known to incorporate auxiliary acceleration pumps which use negative pressure to boost the delivery of fuel during acceleration periods.

Air pollutants from the exhaust of the two cycle engine are typically much greater than that of a four-cycle engine, because the two cycle engine does not completely bum the fuel within the combustion chamber. To alleviate some of the air pollutant concerns for two cycle engines, the industry is designing toward a leaner fuel to air mixture, and therefor a cleaner bum. Unfortunately, use of a leaner fuel to air mixture causes fuel starvation during engine acceleration periods. Sudden acceleration from idle of a cold engine may result in a stall due to lack of sufficient fuel. Moreover, use of the common auxiliary acceleration pump which is dependent upon negative pressure, is not responsive for a lean mixture engine because negative pressure is lacking during acceleration periods.

SUMMARY OF THE INVENTION

An acceleration device of a carburetor provides additional fuel to a two-cycle engine brought on by decreasing negative pressure during acceleration conditions. A carburetor body houses a scavenging passage and an air intake passage opened and closed via a scavenging valve and a throttle valve respectively. The scavenging and throttle valves are preferably integral to a single rotary dual valve and share a common axis of rotation. During steady engine operating conditions, fuel is supplied from a substantially constant pressure fuel supply chamber through a fuel supply tube and into a throttle hole of the throttle valve. The fuel is drawn from the throttle hole via negative pressure of the air intake passage when the intake passage is in communication with the throttle hole. During engine acceleration conditions, additional fuel is pushed into the throttle hole by inward movement of a diaphragm into the fuel supply chamber.

Preferably, a membrane disposed between a pump chamber or chamber and an actuation chamber or chamber of an acceleration pump pushes air into or increases the pressure in an air reference chamber housed within the carburetor body and communicating with the diaphragm of the fuel supply chamber. The membrane is actuated when a compressed resilient member, normally held back by a vacuum within the actuation chamber, pushes the membrane into the pump chamber when the vacuum is lost during engine acceleration conditions. The pushed air, in turn, forces the diaphragm into the fuel supply chamber. The vacuum within the actuation chamber is created by a suction from the scavenging passage during steady state engine operation.

Objects, features and advantages of this invention include providing a fuel acceleration device which is actuated by a sudden increase in pressure within a carburetor scavenging passage. The acceleration device thereby provides smooth acceleration of a lean burn two cycle engine even during cold operation, improved fuel efficiency and decreased engine emissions.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figures 1, 2:
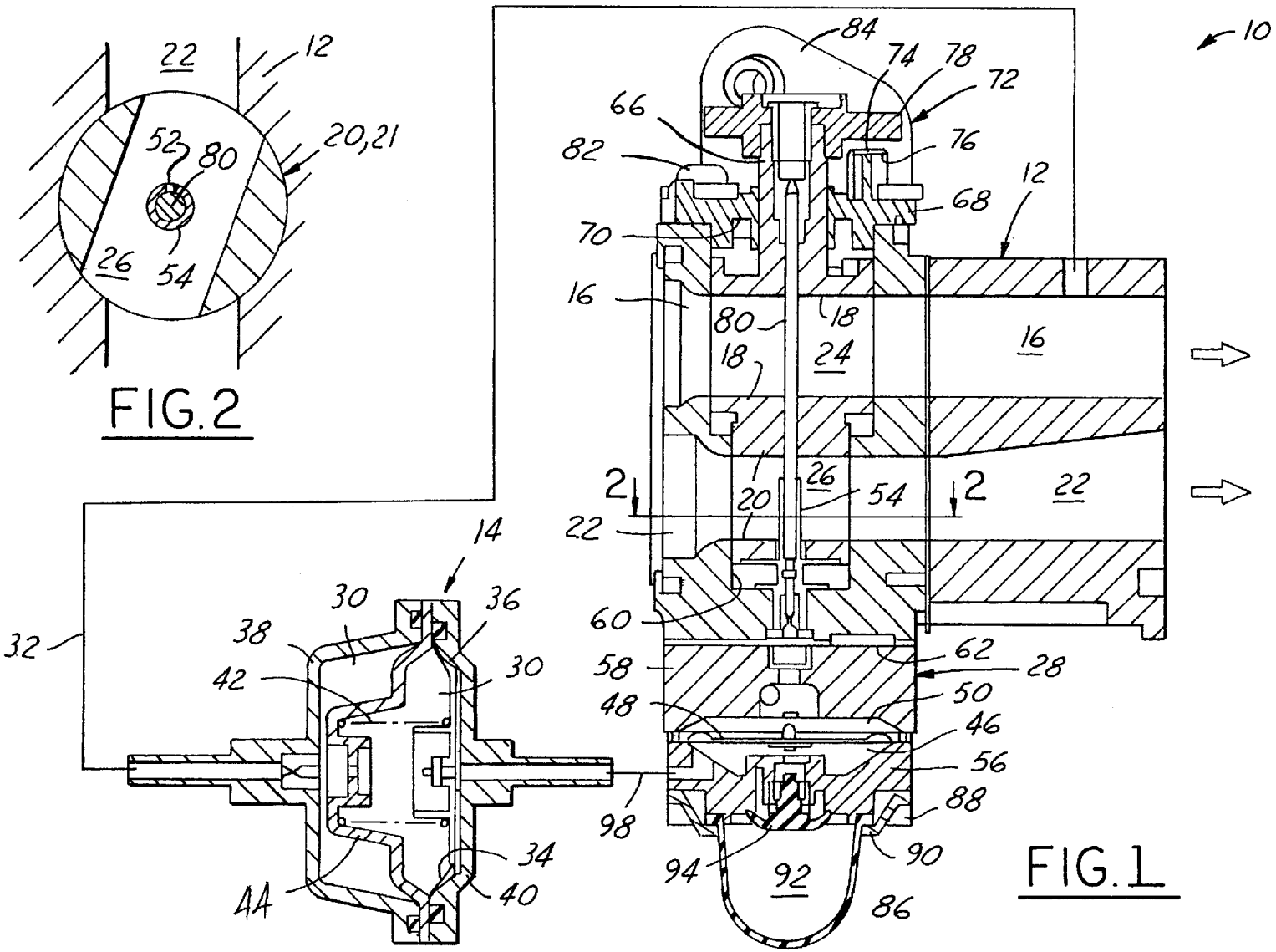
FIG. 1 is a sectional side view of an acceleration device for a two cycle engine according to the present invention.
FIG. 2 is a sectional view of a rotary throttle valve of the acceleration device taken along line 2—2 in FIG. 1.

Referring in more detail to the drawings, FIG. 1 is a sectional side view of an acceleration device 10 embodying the present invention. The acceleration device 10 is integral in part with a body 12 of a carburetor for a two-cycle or two stroke engine. The remainder of the acceleration device 10, is not necessarily part of the carburetor body 12, and comprises an acceleration pump 14. The acceleration pump 14 is responsive to air pressure within a scavenging passage 16 extending through carburetor body 12. The scavenging passage 16 is in communication with a combustion chamber of the engine. Also extending through the carburetor body 12 is an air intake and fuel mixing passage 22 communicating with a crankcase of the two-cycle engine, not shown.

Referring to FIGS. 1 and 2, a scavenging valve 18 and a throttle valve 20 coincidingly throttle, open and close, the scavenging and air intake passages 16, 22 respectively. Although the scavenging and throttle valves 18, 20 may take a variety of forms, such as pivoting plates, preferably they are of a rotary, cylindrical, type extending transversely across the scavenging and air intake passages 16, 22 respectively. As rotary valves, the scavenging valve 18 has a scavenging hole 24 and the throttle valve 20 has a throttle hole 26. The holes 24, 26 are generally coincident with and conform to passages 16, 22 respectively when in the full open position. Although valves 18, 20 may be disposed side by side having parallel axes of rotation, preferably, the valves 18, 20 are stacked thereby having a common axis of rotation. In the preferred configuration, the scavenging valve 18 and scavenging passage 16 are generally disposed above the throttle valve 20 and air intake passage 22. The preferred scavenging valve 18 and the preferred throttle valve 20 together comprise a dual valve 21. Dual valve 21 has a stepped cylindrical shape for mounting rotatably to the carburetor body 12 generally from above.

To a left side, the carburetor body 12 connects to an air-cleaning device via a seal member, and to a right side, the carburetor body 12 connects to a wall of the engine, not shown. At an end of a combustion stroke of an operating two-stroke engine, air is drawn through the scavenging hole 24 and the scavenging passage 16 into the combustion chamber. Also, air is drawn through the throttle hole 16 and the air intake passage 22 into the crankcase of the engine.

The acceleration pump 14 translates air pressure changes in the scavenging passage 16 into air volumetric movement within a constant pressure fuel supply mechanism 28 located in the carburetor body 12. Opening the throttle valve 18 of the air intake passage 22 to accelerate the operating engine results in air pressure changes within the scavenging passage 16. During acceleration periods, the negative pressure in the scavenging passage 16 decreases, causing the acceleration pump 14 to move air volume into the constant pressure fuel supply mechanism 28. The fuel supply mechanism 28 uses this air movement to deliver additional fuel into the air intake passage 22. The acceleration pump 14 thereby assists the fuel supply mechanism 28 in supplying additional fuel to the air intake passage 22 during high fuel demand periods brought on by engine acceleration.

As previously stated, when the throttle valve 20 opens, the operating engine accelerates and the existing negative air pressure within the scavenging passage 16 decreases. The decrease in negative air pressure is communicated to an actuation chamber or chamber 30 of the acceleration pump 14, via a pipe 32, causing movement of an adjacent membrane 34. Membrane 34 seals and divides the actuation chamber or chamber 30 from a pump chamber or chamber 36 of the acceleration pump 14. The actuation chamber 30 is generally defined by a first housing portion 38 and the membrane 34. The pump chamber 36 is generally defined by a second housing portion 40 and the membrane 34. The first housing portion 38 rigidly connects and seals to the second housing portion 40. A resilient member 42 such as a spring is biased against the membrane 34 and acts to move the membrane 34 toward or into the pump chamber 36, away from the actuation chamber 30 during low negative pressure conditions in the scavenging passage 16 brought on by engine acceleration.

During non-accelerating engine conditions, the negative pressure holds or sucks the membrane 34 or spring into the actuation chamber 30, against the bias of the resilient member or spring 42. The resilient member 42 may be disposed either within the actuation chamber 30 or the pump chamber 36. If the resilient member 42 is within the actuation chamber 30, the negative pressure of the actuation chamber 30 tends to retract or compress the resilient member 42. However, if the resilient member 42 is in the pump chamber 36, the negative pressure of the actuation chamber 30 will tend to elongate or expand the resilient member 42. Preferably, the resilient member 42 is a compressible spring and therefore located in the actuation chamber 30.

Resilient member or spring 42 therefore cooperatively seats between the first member 38 and the membrane 34. To simplify assembly and to provide operable guidance for the resilient member 42, a bridge 44 is disposed within the actuation chamber 30. The bridge 44 is stationary with respect to the first and second housing portions 38, 40 and rigidly connects to either the first or second housing portions 38, 40. Preferably, the bridge 44 attaches unitarily to the second housing portion 40. This way, the resilient member or spring 42 seats between the bridge 44 and the membrane 34 prior to installation of the first housing portion 38 onto the second housing portion 40 over the bridge 44.

When, the operating engine is accelerating and thus requires more fuel, the actuation chamber 30 loses negative pressure. The resilient membrane 34 senses the loss of negative pressure within the actuation chamber 30 and is displaced by the force produced by the resilient member spring 42. Without the negative pressure causing the membrane 34 to be disposed back into the actuation chamber 30, the resilient member or spring 42 pushes or forces the membrane 34 into the pump chamber 36 which then transfers air volume into the constant pressure fuel supply mechanism 28. When resilient member 42 is located in the actuation chamber 30, the membrane 34 is pushed by resilient member 42. As stated previously, this is preferable over pulling the membrane 34 which would be the case if the resilient member 42 is located in the pump chamber 36.

An air reference chamber 46 of the fuel supply mechanism 28 accepts the additional air volume through the displacement of a diaphragm 48 into a metering fuel chamber 50. The volumetric decrease of the metering fuel chamber 50 has the effect of pushing or displacing liquid fuel therein into the air intake passage 22 through a fuel port 52 located in a fuel supply tube 54. The diaphragm 48 is clamped between an outward member 56 and an intermediate member 58 of the carburetor body 12. The intermediate member 56 and a face of the diaphragm 48 define the metering fuel chamber 50. An opposite face of the diaphragm 48 and the outward member 56 define the air reference chamber 46. The metering fuel chamber 50 is disposed generally between the fuel supply tube 54 and the air reference chamber 46.

The fuel supply tube 54 connects to a bottom part of a valve chamber 60 and communicates with the metering fuel chamber 50 via a check valve. A fuel pump has a membrane 62 generally clamped within the carburetor body 12 and an inlet or suction valve, and an outlet or discharge valve which are not shown. By moving the membrane 62 with pulsation pressure in a crank case of the two cycle engine, fuel in a fuel tank (not shown) is drawn into a pump chamber of the fuel pump and supplied to the metering fuel chamber 50 through the outlet valve and a fuel metering valve actuated by the diaphragm 48.

During non-accelerating engine operating conditions, fuel in the metering fuel chamber 50 is drawn through the fuel supply tube 54, the fuel port 52, and into a throttle hole 26 of the throttle valve 20. The throttle hole 26 is in throttling communication with the air intake passage 22 which is exposed to negative pressure from the crank case of a two cycle or stroke engine. When the amount of the fuel in the metering fuel chamber 50 decreases and the diaphragm 48 moves into the metering fuel chamber 50 via a negative pressure in the air intake passage 22, a fuel metering valve is opened by a lever associated with the diaphragm 48 and the fuel pump replenishes the fuel in the chamber 50. In this manner, the fuel in the metering fuel chamber 50 is maintained at a substantially constant level.

On the other hand, during acceleration conditions, the fuel in the metering fuel chamber 50 is forcibly sent or discharged through the supply tube 54 into the passage 22 by movement of the diaphragm 48 into the metering fuel chamber 50 caused by air supplied to the chamber 46 by the acceleration pump 14. This increases the amount of fuel delivery to and thus provides a smooth acceleration of the engine.

Dual valve 21 has an integral shaft 66 which extends longitudinally and projects outwardly through a lid 68 of the carburetor body 12. A throttle valve lever 78 extends radially and is attached to the shaft 66 above the lid 68. The rotary dual valve 21 is biased to a substantially closed engine idling position by a coil spring 70. The coil spring 70 encircles the shaft 66 and is received between the lid 68 and the rotary dual valve 21. One end of the spring 70 engages with the rotary dual valve 21 and the other end engages with the lid 68. The rotary dual valve 21 is thereby forced to rotate to an idling position, wherein the scavenging and air intake passages 16, 22 are partially closed, by the spring 70 with the assistance of a cam mechanism 72.

The cam mechanism 72 comprises a follower 74 upwardly projecting from the lid 68, and a cam face 76 facing downward from the throttle valve lever 78. The cam face 76 is urged onto the follower 74 by the force of the spring 70. When the rotary dual valve 21 rotates in an opening or accelerating direction, the scavenging passage 16 further opens as the scavenging hole 24 rotates, and the air intake passage 22 further opens as the throttle hole 26 rotates. At the same time, a needle valve 80, supported by the shaft 66 of the rotary dual valve 21 and inserted into the fuel supply tube 54, is lifted upward by the action of the cam mechanism 72, thereby further exposing or opening the fuel port 52 of the fuel supply tube 54 to the air intake passage 22.

The lid 68 attaches to the carburetor body 12 by means of a plurality of bolts 82. An outer sheath of a remote control cable is attached to a wall portion 84 projecting upward from the lid 68. An inner wire passes through the outer sheath and is connected to the throttle valve lever 78 by means of a swivel. In this manner, the throttle valve lever 78 can be remotely controlled by an operator of a working machine carrying the engine to which the carburetor is connected.

A syringe or flexible rubber dome 86 of a manual suction pump is attached to a lower face of the outer member 56 and has a peripheral edge retained by bolts 88 and a holding plate 90. The dome 86 and the lower face of the outer member 56 generally define a pump chamber 92 in which a mushroom shaped complex valve 94 is received and functions as both a suction valve and a discharge valve. Repeatedly manually pushing and releasing the syringe 86, prior to starting the engine, causes vaporized fuel and air in the metering fuel chamber 50 to be drawn into the pump chamber 92 through the inlet portion of the complex valve 94, and then returned to the fuel tank through a shaft portion of the complex valve 94. Since the metering fuel chamber 50 is subjected to a negative pressure, fuel in the fuel tank is supplied to the metering fuel chamber 50 through the fuel pump and the metering valve. Because such structure has been disclosed in Japanese Publication No. 9-268917 (Application No. 8-1906186 filed Apr. 3, 1996) of an unexamined patent application, for example, a further explanation is omitted here.

The operation of the acceleration device 10 in a two-cycle engine according to the invention is described hereinbelow. When the throttle valve lever 78 is rotated in an engine accelerating direction, the scavenging hole 24 with respect to the scavenging passage 16 and the throttle hole 26 with respect to the air intake passage 22 further opens. At the same time, the needle 80 is moved upward by the cam mechanism 72 and the fuel port 52 is further exposed within the air intake passage 22. The pressure in the scavenging passage 16 becomes almost equal to the atmospheric pressure, and the scavenged air in the scavenging passage 16 enters in the actuation chamber 30 via the pipe 32 so that the membrane 34 is moved into the pump chamber 36 by the force of the resilient member or spring 42. This movement of the membrane 34 displaces air in the pump chamber 36 to the air reference chamber 46 via a passage 98. This moves the diaphragm 48 into the metering fuel chamber 50, and causes fuel in the metering fuel chamber 50 to be discharged into the throttle hole 26 via the check valve and the fuel supply tube 54 which increases the amount of the fuel in the air, providing a smooth acceleration of the engine. When the engine again arrives at steady operation, a strong scavenging negative pressure exists in the scavenging passage 16 which causes the membrane 34 in the acceleration pump 14 to gradually move back toward the actuation chamber 30 against the force of the resilient member or spring 42 and air in the air reference chamber 46 to be drawn into the pump chamber 36.

While the forms of the invention herein disclosed constitute presently preferred embodiments, many others are possible. For instance, the acceleration pump 14 can be an integral part of the carburetor body 12. With this orientation, the pump chamber 36 and the passage 98 are not required. The air reference chamber 46 is thereby defined directly between the diaphragm 48 and the membrane 34. Regardless, it is not intended herein to mention all the possible equivalent forms or ramifications of the invention. It is understood that the terms used herein are merely descriptive, rather than limiting, and that various changes may be made without departing from the spirit or scope of the invention.

We claim:

1. An acceleration device of a carburetor for a two cycle engine comprising:

a carburetor body having an air intake passage and a separate scavenging passage;

a fuel supply port in communication with the air intake passage;

a metering fuel chamber carried by the carburetor body and communicating with the air intake passage through the fuel port;

a first housing portion having an actuation chamber communicating with the scavenging passage;

a membrane disposed operatively between the fuel metering chamber and the actuation chamber, the actuation chamber defined by the first housing portion and the membrane; and a resilient member engaged with the membrane and constructed and arranged to resist the forces produced by negative pressure within the actuation chamber exerted upon the membrane, the metering fuel chamber constructed and arranged to supply fuel to the air intake passage via the fuel supply port, wherein the fuel is supplied to the fuel port by suction from the air intake passage during steady-state operation of the engine and by expansion of the actuation chamber by outward movement of the membrane from the first housing portion during acceleration of the engine causing fuel to be discharged from the fuel metering chamber into the air intake passage through the fuel supply port.

2. The acceleration device according to claim 1 wherein the resilient member is a spring disposed within the actuation chamber, the spring compressed between the membrane and the first housing portion.

3. The acceleration device according to claim 2 comprising:

an air reference chamber carried by the carburetor body; and a diaphragm disposed between the metering fuel chamber and the air reference chamber, the diaphragm having a diaphragm face and an opposite diaphragm face, the fuel metering chamber defined by the carburetor body and the diaphragm, face, the air reference chamber disposed between the diaphragm and the membrane, the opposite diaphragm face defining the air reference chamber.

4. The acceleration device according to claim 3 comprising:

a second housing portion engaged rigidly to the first housing portion, the second housing portion having a pump chamber, the pump chamber defined by the membrane and the second housing portion, wherein an acceleration pump is comprised by the first housing portion, the second housing portion, the resilient member, the actuation chamber, and the pump chamber; and a passage disposed between and communicated with the pump chamber and the air reference chamber.

5. The acceleration device according to claim 4 wherein the acceleration pump has a pipe connected between the carburetor body and the first housing portion of the acceleration pump, the pipe providing communication between the scavenging passage and the actuation chamber.

6. The acceleration device according to claim 5 comprising:

a throttle valve disposed in the air intake passage of the carburetor body;

a scavenging valve cooperating with the throttle valve and disposed in the scavenging passage; and the acceleration pump having a bridge disposed within the actuation chamber and engaged rigidly to the first and second housing portions, the resilient member biased between the bridge and the membrane.

7. The acceleration device according to claim 4 wherein the pump chamber pressure is atmospheric.

8. The acceleration device according to claim 1 wherein the actuation chamber pressure is less than or equal to the pump chamber pressure.

9. The acceleration device according to claim 1 wherein the actuation chamber is in communication with the scavenging passage.

10. The acceleration device according to claim 9 wherein the pump chamber is in communication with the air reference chamber.

11. An acceleration device of a carburetor in a two cycle engine comprising:

a carburetor body having an air intake passage and a scavenging passage;

a throttle valve disposed in the air intake passage of the carburetor body, the throttle valve having a throttle hole;

a scavenging valve cooperating with the throttle valve and disposed in the scavenging passage;

a metering fuel chamber disposed in the carburetor body;

a fuel supply tube in communication between the metering fuel chamber and the throttle hole of the throttle valve, the metering fuel chamber constructed and arranged to supply fuel to the throttle hole via the fuel supply tube, wherein the fuel is supplied to the throttle hole by suction from the air intake passage during steady-state operation of the engine; and an acceleration pump having an actuation chamber and a membrane, the membrane interconnected communicatively between the actuation chamber and the metering fuel chamber, the membrane defining the actuation chamber, the actuation chamber in communication with the scavenging passage, the membrane constructed and arranged to move outward from the actuation chamber upon a negative pressure decrease within the actuation chamber thereby discharging fuel from metering fuel chamber to the throttle hole during acceleration of the engine.

12. The acceleration device according to claim 11 further comprising:

the metering fuel chamber having a diaphragm; and an air reference chamber disposed in the carburetor body, the diaphragm of the metering fuel chamber disposed between the metering fuel chamber and the air reference chamber, the membrane of the acceleration pump interconnected communicatively between the actuation chamber and the air reference chamber.

13. The acceleration device according to claim 12 wherein the acceleration pump has a pump chamber, the membrane of the acceleration pump is disposed between the actuation chamber and the pump chamber, and the pump chamber is in communication with the air reference chamber.

14. The acceleration device according to claim 13 wherein the actuation chamber is in communication with the scavenging passage.

15. The acceleration device according to claim 14 wherein the acceleration pump has a first housing portion, a second housing portion, a bridge and a resilient member, the first and second housing portions defining the actuation chamber and the pump chamber, the bridge disposed within the actuation chamber and engaged rigidly to the first and second housing portions, the resilient member biased between the bridge and the membrane, the resilient member compressed by the membrane when the actuation chamber is under sufficient negative pressure, the resilient member expanded and the membrane disposed outward from the actuation chamber and inward to the pump chamber when the actuation chamber is under atmospheric pressure.

16. The acceleration device according to claim 15 wherein the acceleration pump has a pipe connected between the carburetor body and the first housing portion of the acceleration pump, and communication between the scavenging passage and the actuation chamber is provided by the pipe.

17. The acceleration device according to claim 16 wherein the acceleration pump has a passage routed between the pump chamber and the air reference chamber.

* * * * *